US010864415B2

(12) United States Patent
Sheldon et al.

(10) Patent No.: US 10,864,415 B2
(45) **Date of Patent: *Dec. 15, 2020**

(54) PUTTER-TYPE GOLF CLUB HEAD WITH ALIGNMENT FEATURE

(71) Applicant: SUMITOMO RUBBER INDUSTRIES, LTD., Kobe (JP)

(72) Inventors: Adam K Sheldon, Long Beach, CA (US); Mika Becktor, Costa Mesa, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/152,829

(22) Filed: Oct. 5, 2018

(65) Prior Publication Data

US 2019/0030405 A1 Jan. 31, 2019

Related U.S. Application Data

(63) Continuation of application No. 14/587,242, filed on Dec. 31, 2014, now Pat. No. 10,092,801.

(51) Int. Cl.
*A63B 53/04* (2015.01)
*A63B 71/06* (2006.01)

(52) U.S. Cl.
CPC ..... *A63B 53/0487* (2013.01); *A63B 53/0408* (2020.08); *A63B 53/0441* (2020.08); *A63B 2071/0694* (2013.01); *A63B 2225/09* (2013.01)

(58) Field of Classification Search
CPC ..... A63B 53/0487; A63B 2225/09; A63B 2071/0694; A63B 2053/0441; A63B 2053/0408
See application file for complete search history.

(56) References Cited

U.S. PATENT DOCUMENTS 1,537,320 A 5/1925 Marsh
2,503,506 A * 4/1950 Miller ..... A63B 69/3685 473/251

(Continued)

FOREIGN PATENT DOCUMENTS

GB 2462391 B * 7/2012 ..... A63B 53/0487
JP H08-215358 A 8/1996

(Continued)

OTHER PUBLICATIONS

Never Compromise Stubby Putter, Mar. 5, 2003, <http://www.golfmagic.com/news/equipment-news/make-way-for-stubby/3187.html>.

(Continued)

*Primary Examiner* — Stephen L Blau
(74) *Attorney, Agent, or Firm* — Oliff PLC

(57) ABSTRACT

A putter-type golf club head that, when oriented in a reference position, includes a blade portion comprising a striking face, a top line, and a sole, the striking face including a face center. A rear portion of the club head is in communication with, and rearward of, the blade portion. An alignment element of the club head is rearward of, and recessed toward the sole from, the top line, and the alignment element defines a virtual center line segment oriented in a substantially front-to-rear direction at a height equal to about 21.3 mm to about 21.4 mm. The center line segment is not spaced more than 10 mm from a virtual vertical plane passing through the face center and extending generally perpendicular to the striking face, and a width of the club head is no less than 3.0 in.

14 Claims, 12 Drawing Sheets

(56) References Cited

U.S. PATENT DOCUMENTS 3,260,525 A 7/1966 Ortel
D209,294 S 11/1967 Hitt
3,632,112 A 1/1972 Jacobs
D228,563 S 10/1973 Brower
D228,930 S 10/1973 Leigh
D229,434 S 11/1973 Brower
D234,961 S 4/1975 Swash
3,880,430 A * 4/1975 McCabe ..... A63B 69/3685 473/253
4,141,556 A 2/1979 Paulin
4,324,404 A 4/1982 Dian
D291,343 S * 8/1987 Shearer ..... D21/744
4,693,478 A 9/1987 Long
D297,964 S 10/1988 Shearer
4,852,879 A 8/1989 Collins
D310,699 S 9/1990 Parente et al.
4,986,544 A * 1/1991 Benson ..... A63B 53/0487 473/254
4,999,000 A 3/1991 Finney
5,062,639 A 11/1991 Hilt
D322,647 S 12/1991 Antonious
D322,648 S 12/1991 Antonious
D322,649 S * 12/1991 Antonious ..... D21/742
D322,829 S * 12/1991 Antonious ..... D21/742
5,072,941 A 12/1991 Klein
5,082,277 A 1/1992 Gingold
5,102,139 A 4/1992 Greig
5,125,664 A * 6/1992 Evans ..... A63B 69/3685 434/252
5,127,653 A 7/1992 Nelson
5,174,573 A 12/1992 Desbiolles et al.
5,308,068 A * 5/1994 Strand ..... A63B 53/02 473/251
5,344,141 A 9/1994 Smith
5,417,429 A * 5/1995 Strand ..... A63B 69/3685 473/251
5,423,544 A * 6/1995 Ichikawa ..... A63B 69/3685 473/340
D360,669 S 7/1995 Buscemi et al.
5,447,313 A * 9/1995 Finley ..... A63B 69/3685 473/244
D366,081 S 1/1996 Patten
5,489,097 A 2/1996 Simmons
5,538,249 A * 7/1996 Benson ..... A63B 69/3685 473/251
5,599,241 A * 2/1997 Pritchett ..... A63B 53/0487 473/238
D385,320 S 10/1997 Schmidt
5,947,837 A 9/1999 Perry
5,993,324 A 11/1999 Gammil
D431,850 S * 10/2000 Yang ..... D21/736
6,558,268 B2 5/2003 Tindale
6,796,911 B2 9/2004 Grace
6,817,953 B2 * 11/2004 Farmer ..... A63B 53/02 473/251
D505,702 S 5/2005 Wood
D505,703 S 5/2005 Fiskari
6,962,537 B2 11/2005 Johnson
7,014,566 B1 * 3/2006 Norvise ..... A63B 53/0487 473/231
7,169,061 B2 * 1/2007 Hou ..... A63B 53/0487 473/341
7,364,514 B2 * 4/2008 Yamaguchi ..... A63B 53/0487 473/340
7,611,419 B2 * 11/2009 O'Neill ..... A63B 53/04 473/242
7,625,298 B2 12/2009 Bennett
7,766,762 B2 * 8/2010 Stellander ..... A63B 53/0487 473/251
7,905,793 B2 * 3/2011 O'Neill ..... A63B 53/04 473/242
7,927,226 B1 * 4/2011 Twitty ..... A63B 53/0487 473/251
8,109,838 B2 2/2012 Solheim et al.
8,382,604 B2 * 2/2013 Billings ..... A63B 53/0487 473/244
8,465,381 B2 * 6/2013 Rajagopalan ..... A63B 37/0043 473/373
D688,341 S 8/2013 Rollinson
8,616,992 B2 * 12/2013 Kim ..... A63B 53/0487 473/252
8,894,501 B1 * 11/2014 Stillwagon ..... A63B 69/3614 473/220
D728,715 S 5/2015 Cameron
D768,248 S 10/2016 Rollinson
D771,208 S 11/2016 Bettinardi
D773,573 S 12/2016 Abbott et al.
D776,771 S 1/2017 Peterson
9,675,864 B1 * 6/2017 Carter ..... A63B 69/3685
D799,617 S 10/2017 Becktor et al.
D801,457 S 10/2017 Lewis
D807,453 S 1/2018 Serrano et al.
9,914,024 B2 * 3/2018 Simizu ..... A63B 53/0487
9,914,040 B2 * 3/2018 Carter ..... A63B 69/3685
D844,722 S 4/2019 Wang et al.
10,252,124 B2 * 4/2019 Trahan ..... A63B 53/0487
10,300,348 B2 5/2019 Morris
D855,132 S 7/2019 Schweigert
D860,356 S 9/2019 Rollinson
10,456,637 B2 * 10/2019 Becktor ..... A63B 53/0487
D867,497 S 11/2019 Broom
D895,748 S 9/2020 Rollinson et al.
2002/0025859 A1 * 2/2002 Finn ..... A63B 53/0487 473/340
2003/0054900 A1 * 3/2003 Tindale ..... A63B 53/0487 473/340
2003/0207725 A1 * 11/2003 Sanchez ..... A63B 53/02 473/340
2004/0166953 A1 8/2004 Grace
2005/0187028 A1 * 8/2005 Chang ..... A63B 53/0487 473/231
2006/0058113 A1 3/2006 Hasegawa
2006/0094533 A1 5/2006 Warren et al.
2006/0223649 A1 * 10/2006 Rife ..... A63B 53/0487 473/334
2006/0258475 A1 * 11/2006 Lee ..... A63B 53/0487 473/226
2007/0129163 A1 * 6/2007 Solari ..... A63B 53/0487 473/336
2007/0135232 A1 6/2007 Billings
2007/0191135 A1 8/2007 Nilsson et al.
2009/0233726 A1 * 9/2009 Thornes ..... A63B 53/0487 473/220
2010/0173720 A1 * 7/2010 Kim ..... A63B 53/0487 473/252
2013/0203522 A1 * 8/2013 Franklin ..... A63B 53/007 473/341
2014/0162801 A1 * 6/2014 Stillwagon ..... A63B 69/3614 473/220
2014/0228146 A1 8/2014 Saito
2015/0343275 A1 12/2015 Hamada
2016/0184670 A1 6/2016 Sheldon et al.
2019/0022482 A1 * 1/2019 Sanyal ..... A63B 53/065
2019/0240543 A1 8/2019 Morris
2020/0101357 A1 4/2020 Higdon et al.

FOREIGN PATENT DOCUMENTS

WO WO-2004009187 A1 * 1/2004 ..... A63B 53/0487
WO WO-2008040048 A1 * 4/2008 ..... A63B 53/0487

OTHER PUBLICATIONS

Cobra Golf Optica SL-02 Putter, Jan. 27, 2007, 2007 Cobra Golf product catalog p. 45-46.

Bobby Grace the Heavyweight Champion Putter, Nov. 9, 2014, <http://www.ebay.com/itm/RARE-NEW-BOBBY-GRACE-HEAVYWEIGHT-CHAMPION-50-IN-BELLY-PUTTER-WITH-

(56) References Cited

OTHER PUBLICATIONS

HEAD-COVER-/261648085906?pt=Golf_Clubs&hash=item3ceb70f392>.
Bobby Grace Cute Kid Putter, Nov. 26, 2007, <http://valueguide.pga.com/detail-exec/brand/2678/product_type/206/model/43637/b/Cobra/p/Putter/m/Bobby%20Grace%20The%20Cute%20Kid>.
Bobby Grace the Soft Lady Putter, Feb. 5, 2014, <http://www.ebay.com/itm/LEFT-HAND-COBRA-BOBBY-GRACE-THE-SOFT-LADY-PUTTER-golf-club-/390404525366>.
Bionik 501 Putter, Dec. 16, 2014, <http://www.hirekogolf.com/golf-clubs/custom-golf-clubs/golf-putters/bionik-501-putter-custom-assembled.html>.
Tommy Armour T-Line Putter, Feb. 5, 2014, <http://www.ebay.com/itm/TOMMY-ARMOUR-T-LINE-PUTTER-golf-club-34-/330639188846>.
Bobby Grace Pay Day Putter, Nov. 26, 2007, <http://www.ebay.com/itm/Cobra-Bobby-Grace-The-Pay-Day-Putter-34-1-2-/351203113032>.
Taylor Made Golf TC-1 putter, Aug. 31, 2013,<http://www.clubsofdistinction.com/cod/cucput0329.html>.
Cleveland Golf Classic Collection HB 1 Black Pearl Putter, Dec. 19, 2013,<http://www.clevelandgolf.com/US_classic-collection-hb-1-black-pearl-putter_cchb_1_bpputter_viewProd_putters.html>.
Tear Drop Tear Drop Putter, Mar. 24, 2012, <http://valueguide.pga.com/detail-exec/brand/2764/product_type/206/model/44681/b/Tear%20Drop/p/Putter/m/Tear%20Drop>.
Dave Pelz 3-Ball Putter, Oct. 17, 2014, <http://www.ebay.com/itm/Dave-Pelz-3-ball-putter-short-face-Extremely-Rare-/121462461477?pt=LH_DefaultDomain_0&hash=item1c47ba1425>.
SeeMore M3 Putter, Jan. 29, 2009, 2009 SeeMore Product Catalog p. 1, 2, and 5.
Aug. 17, 2016 Office Action issued in U.S. Appl. No. 14/587,242.
Jan. 30, 2017 Office Action Issued in U.S. Appl. No. 14/587,242.
Jul. 14, 2017 Office Action Issued in U.S. Appl. No. 14/587,242.
Nov. 29, 2017 U.S. Office Action Issued in U.S. Appl. No. 15/235,771.
Dec. 28, 2017 Office Action issued in U.S. Appl. No. 14/587,242.
Apr. 27, 2018 Office Action issued in U.S. Appl. No. 15/235,771.
Apr. 12, 2018 Office Action issued in U.S. Appl. No. 15/235,771.
Dec. 23, 2019 Office Action issued in U.S. Appl. No. 16/255,313.
May 22, 2020 Office Action issued in U.S. Appl. No. 16/255,313.
Sep. 25, 2020 Notice of Allowance issued in U.S. Appl. No. 16/255,313.

* cited by examiner

PUTTER-TYPE GOLF CLUB HEAD WITH ALIGNMENT FEATURE

This application is a Divisional of application Ser. No. 14/587,242, filed Dec. 31, 2014. The entire content of this prior application is hereby incorporated by reference.

BACKGROUND

A critical component of effective putting is the ability to properly align a putter-type golf club with the golf ball and the cup. To better facilitate this proper alignment, various solutions have been proposed and carried out. For example, a putter-type golf club head has been produced with a sightline formed via a groove on its upper rear surface. This sightline is typically placed at the lateral midpoint (e.g., center) in the heel-to-toe direction of the club head, and this sightline typically projects in a direction generally perpendicular to the striking wall of the club head (i.e., the front-to-rear direction). A golfer may typically attempt to align this sightline (particularly in the horizontal or heel-to-toe direction) during a preliminary static fit at address (i.e., when the golfer places the club head directly on the turf and orients it before swinging) so that it is perceived to project through the center of a golf ball to be struck. Generally, alignment of such sightlines with the centers of golf balls leads to best performance. However, in such past attempts, a golfer's ability to properly laterally align a golf club head with a golf ball has been limited by deficiencies in the orientation and position of such sightlines.

SUMMARY

As shown in FIG. 1, the position of a golfer's head, and thus his eyes, in the static preliminary position at address is neither fixed nor consistent from golfer to golfer. The sightline position (e.g., relative to a golf ball intended to be impacted) perceived by the golfer at address may therefore vary, thus causing distractions to the golfer and making it more difficult to laterally orient the golf ball relative to the club head. For example, in position A in FIG. 1, in which the golfer's eyes are positioned generally directly over the club head (e.g., are intersected by a plane that is perpendicular to the ground plane, that intersects the face center of the club head, and that is parallel to the front-to-rear direction), it is indeed relatively easy to laterally align the golf ball relative to the club head. As shown in position A in FIG. 2, when the sightline and the center of the ball are perceived to be aligned by the golfer, the center of the ball is also positioned midway between the toe and the heel of the club head. But in position B in FIG. 1, in which the golfer's eyes are angularly offset by, say 30°, it becomes much more difficult to laterally orient the golf ball relative to the club head. As shown in position B in FIG. 2, this difficulty arises because the sightline on the club head as perceived by the golfer is no longer aligned with the lateral midpoint of the club head. There was thus perceived by the present inventors a need for a putter-type club head that allows a golfer to properly align the putter in the static preliminary position at address, regardless of whether the golfer's eyes are angularly offset from being directly vertical above the ball.

According to investigations carried out by the present inventors, the perceived change in the sightline between positions A and B is a result of discrepancy between the radius of the golf ball (and thus the height of the center of the golf ball above the ground plane) and the location of the sightline on the club head. In particular, the present inventors noted that when the height of the sightline nears the radius of the golf ball, the perceived change in the location of the sightline from a golfer's eyes being directly over the ball to being angularly offset significantly decreases. It thus becomes easier for the golfer to laterally align the club head relative to the center of the golf ball regardless of the golfer's eye position.

Therefore, one non-limiting example of the putter-type golf club head according to one or more aspects of the present disclosure may include a blade portion comprising a striking face, a top line, and a sole, the striking face including a face center. A rear portion of the club head may be in communication with, and rearward of, the blade portion. An alignment element of the club head may be rearward of, and recessed toward the sole from, the top line, and the alignment element may define a virtual center line segment oriented in a substantially front-to-rear direction at a height equal to about 21.3 mm to about 21.4 mm. The center line segment may not be spaced more than 10 mm from a virtual vertical plane passing through the face center and extending generally perpendicular to the striking face, and a width of the club head may be no less than 3.0 in.

In another non-limiting example, a putter-type golf club head according to one or more aspects of the present disclosure may include a blade portion comprising a striking face, a top line, and a sole, the striking face including a face center. A rear portion of the club head may be in communication with, and rearward of, the blade portion and have a rear portion top surface. A projection may extend upwardly from the rear portion top surface, and the projection may have a projection top surface. And an alignment element may be formed in the projection top surface, the alignment element defining a virtual center line segment oriented in a substantially front-to-rear direction at a substantially constant height equal to about 21.3 mm to about 21.4 mm.

In yet another non-limiting example, a putter-type golf club head according to one or more aspects of the present disclosure may include a blade portion comprising a striking face, a top line, and a sole, the striking face including a face center. An alignment element of the club head may be rearward of the blade portion, and it may have a first height no greater than 35 mm. The alignment element may define a central axis segment oriented in a substantially front-to-rear direction, and the central axis segment may have a second height from the lowermost point of the sole between 19 mm and 24 mm and less than the first height by at least 1.5 mm.

These and other features and advantages of the putter-type golf club head according to the various aspects of the present disclosure will become more apparent upon consideration of the following description, drawings, and appended claims. The drawings described below are for illustrative purposes only and are not intended to limit the scope of the present invention in any manner. It is also to be understood that, for the purposes of this application, any disclosed range encompasses a disclosure of each and every sub-range thereof. For example, the range of 1-5 encompasses a disclosure of at least 1-2, 1-3, 1-4, 2-3, 2-4, 2-5, 3-4, 3-5, and 4-5. It is also to be understood that, for the purposes of this application, any disclosed range encompasses a disclosure of both inclusive and non-inclusive end points.

BRIEF DESCRIPTION OF THE DRAWINGS

Exemplary embodiments of the present invention will now be described with reference to the accompanying drawings.

DETAILED DESCRIPTION OF THE EMBODIMENTS

Figure 3:
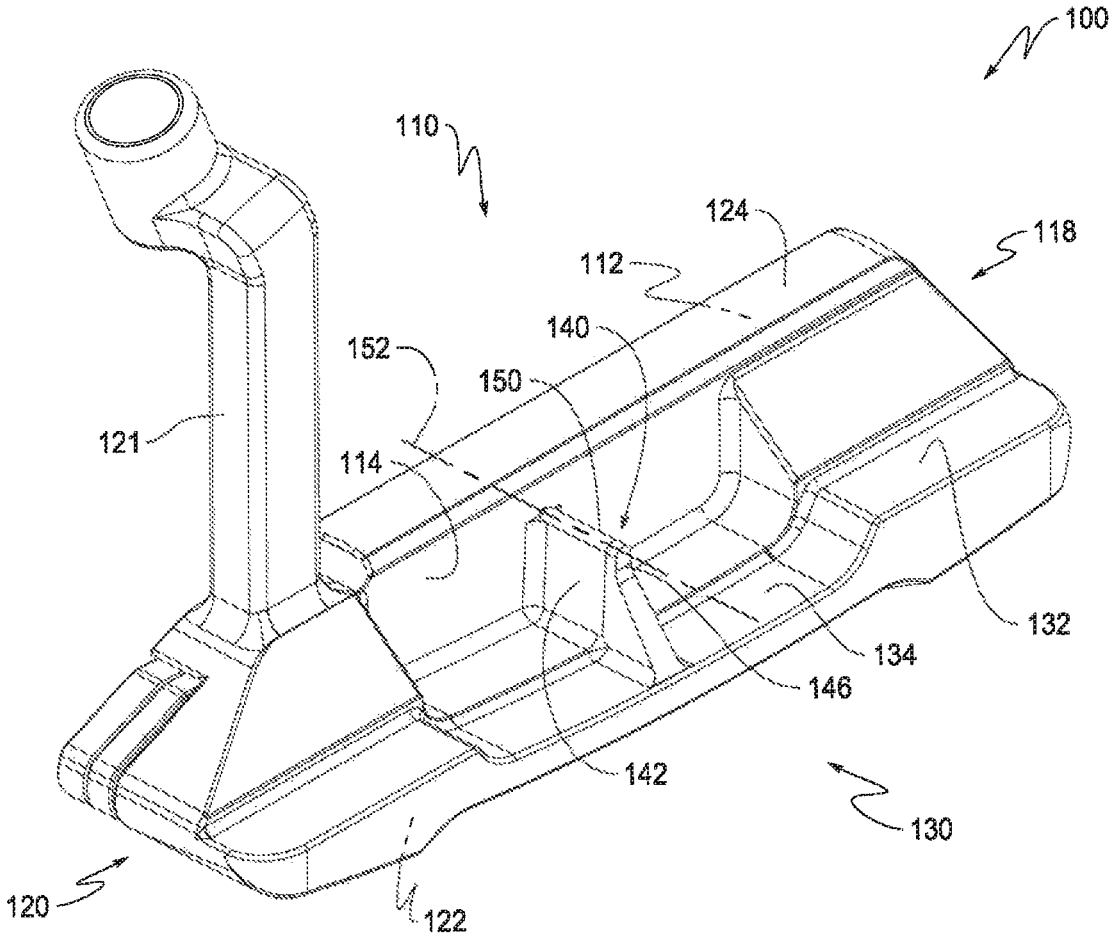
FIG. 3 shows a perspective view of an exemplary putter-type golf club head with an alignment feature in accordance with one or more aspects of the present invention.
Figure 4:
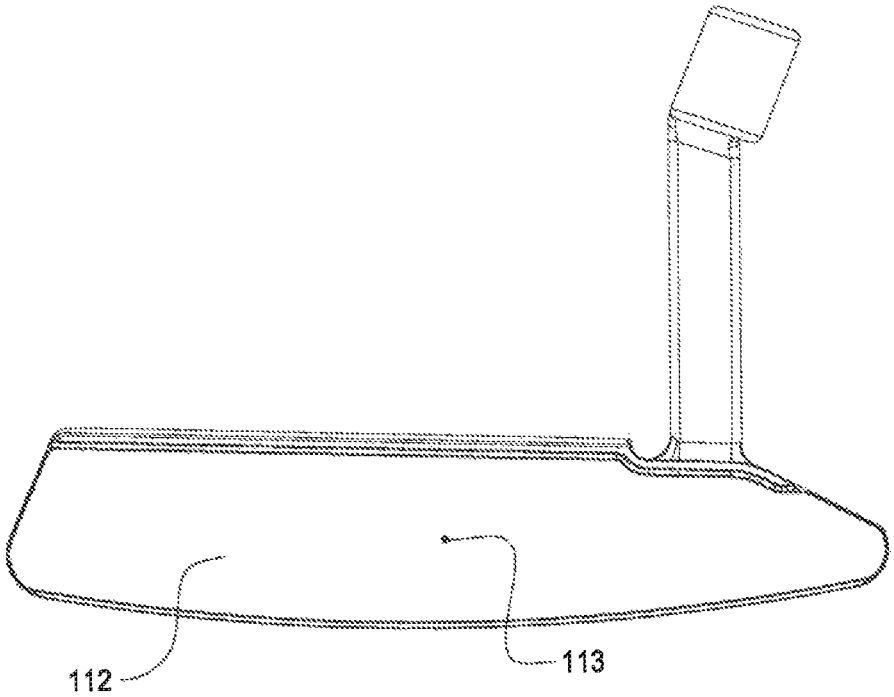
FIG. 4 shows a front side view of the putter-type golf club head of FIG. 3.

Shown in FIG. 3 is a putter-type golf club head 100 according to one or more aspects of the present disclosure. In particular, the club head 100 may be a blade-type putter. The club head 100 may generally be formed from metallic and/or nonmetallic materials, such as any one or a combination of aluminum, stainless steel, titanium, composites, polymeric materials, and any other suitable material. The club head 100 may include a front portion 110 having a striking wall including a striking face 112 for contacting a golf ball and an opposing rear surface 114. As shown in FIG. 4, the striking face 112 may include a face center 113, which is the point on the striking face 112 that is halfway between the heel-most extent and the toe-most extent of the striking face 112 and also halfway between the upper-most extent and lowermost extent of the striking face 112. Returning to FIG. 3, the club head 100 may further include a toe portion 118, a heel portion 120, a sole portion 122, a top line 124, and a rear portion 130. The heel portion 120 may include a hosel 121 configured to receive and secure a shaft (not shown) of the golf club.

The rear portion 130 of the club head 100 may project rearward of the rear surface 114 of the striking wall and the top line 124. The rear portion 130 may include a rear portion top surface 132 recessed toward the sole portion 122 from the top line 124. As shown in FIG. 3, a portion of the rear portion top surface 132 between the toe 118 and the heel 120 may be concave so as to form a recessed rear portion. From the top surface 134 of the recessed rear portion, an alignment projection 140 may project upward toward the top line 124. This alignment projection 140 may comprise a first side surface 142, a second side surface opposite the first side surface 142 (not shown), and a top portion 146 upon which an alignment feature 150 may be placed. The first side surface 142 and the second side surface may have a draft angle of 10 to 20 from the top surface 134 of the recessed rear portion. Draft angles within this range improve castability of the alignment projection 140.

The alignment feature 150 may create a center line 152 that aides a golfer's ability to laterally align the club head 100 with a golf ball in a static preliminary position at address, regardless of whether the golfer's eyes are angularly offset from being directly vertical over the golf ball. As shown in FIG. 3, the alignment feature 150 may be a generally three-dimensional structure such as a partial cylindrical body. As a result, the center line 152 may be a virtual line that is coincident with the longitudinal axis of this partial cylindrical body. Such a three-dimensional constitution is advantageous in that the edges of the alignment feature 150 will always be of the same width as perceived by the golfer, regardless of the angular offset of his eyes. As a result, the visibility of the alignment feature 150 may be improved, and it becomes less distracting if the golfer's eye position wavers. It is also generally advantageous for the alignment feature 150 to be placed on a raised platform such as the alignment projection 140, which allows mass to be conserved in a blade-type putter by enabling a thin rear portion 130. By placing the alignment feature 150 on a raised platform (e.g., as opposed to locating the alignment feature 150 on a relatively thick, uniform thickness rear portion), the center of gravity of the club head 100 is typically lower, thereby optimizing the sweet spot location on the striking face 112. The alignment projection 140 and the alignment feature 150 are discussed further below.

Figure 5:
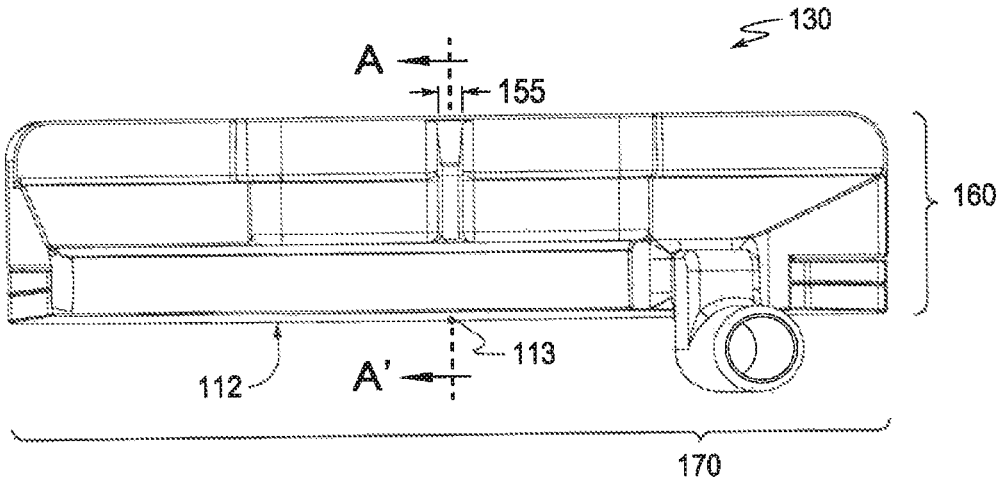
FIG. 5 shows a top plan view of the putter-type golf club head of FIG. 3.

Referring to FIG. 5, the golf club head 100 is shown in top plan view. The golf club head 100 is considered to be in a reference position. "Reference position," as used herein, refers to an orientation of a club head (e.g., club head 100) relative to a ground plane, in which the club head 100 is permitted to rest on the ground plane such that the sole portion 122 of the club head 100 contacts the ground plane at a point midway between a heel-most end of the club head 100 and a toe-most end of the club head 100, and a hosel axis is oriented such that the club head is at its designated loft angle relative to the virtual ground plane. Unless otherwise specified, all club head dimensions described herein are taken with the club head 100 in the reference position.

Figure 6:
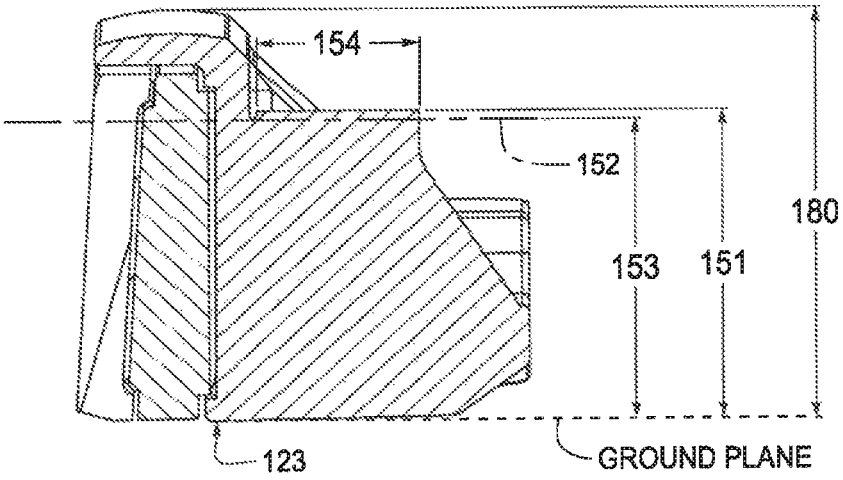
FIG. 6 shows a cross-section view of the putter-type golf club head of FIG. 3.

With reference to the front-to-rear direction in FIG. 5, as it is a blade-type putter, the depth 160 of the club head 100, from the leading edge of the club head to the rearmost point, may be no greater than 1.50 inches. In the lateral (i.e., heel-to-toe) direction, the width 170 of the club head 100 may be no less than 3.0 inches. More specifically, the width 170 may be substantially equal to 4.71 inches. The width 155 of the alignment feature 150 may preferably be no greater than 0.50 in, more preferably between about 0.10 in and about 0.35 in, and even more preferably equal to about 0.25 in. These ranges ensure that minimal mass is directed to providing this alignment feature 150, thus increasing discretionary mass for placement in more suitable locations. Yet, these ranges also ensure sufficient visibility of the alignment feature 150 and structural integrity of the alignment feature 150 with regard to impact, typical wear, and environmental elements. The height 180 of the club head 100, as measured in the vertical direction from the bottom-most point of the sole portion 122 to the top line 124 and as shown in FIG. 6, is preferably greater than the radius of a conventional golf ball, e.g. 21.35 mm, more preferably between 25 mm and 42 mm, and even more preferably, substantially equal to 1.14 inches. These ranges ensure a sufficiently large effective impact zone and sufficiently large club head moment of inertia, particularly about a horizontal axis passing through the club head center of gravity and generally parallel to the striking face. Yet, these ranges also ensure that minimal mass is directed to providing an effective impact zone, thus increasing discretionary mass for placement in more suitable locations. The mass of the club head 100 may preferably be between 250 g and 350 g, more preferably between 280 g and 320 g, and even more preferably, substantially equal to 305 g. These ranges ensure sufficient moment of inertia to provide adequate forgiveness in the case of off-centered golf ball impacts, yet permit appropriate feel and controllability.

With further reference to FIG. 5, a virtual vertical plane A-A' that is perpendicular to the striking face 112 passes through the face center 113. This virtual vertical plane A-A' may bisect the club head 100 along the width 170 in the heel-to-toe direction. The alignment projection 140, the alignment feature 150, as well as the center line 152 are all preferably close to this virtual vertical plane A-A' with respect to the heel-to-toe direction. In particular, the center line 152 may be no more than 5 mm in the heel-to-toe direction from the virtual vertical plane A-A'. Even more specifically, the center line 152 may be no more than 2 mm in the heel-to-toe direction from the virtual vertical plane A-A'. And yet even more specifically, the center line 152 may be substantially coincident with the virtual vertical plane A-A' (e.g., the center line 152 may be in the virtual vertical plane A-A'). If the center line 152 formed by the alignment feature 150 is laterally offset more than the above-mentioned amounts, the below-discussed alignment advantages may be rendered moot.

Turning again to FIG. 6, which shows a cross-sectional view taken along the virtual vertical plane A-A', other dimensions of the alignment projection 140 and of the alignment feature 150 are made apparent. The height 153 of the center line 152, taken vertically from the lowermost point 123 of the sole portion 122, may be from 16 to 26 mm. More specifically, the height 153 may be between 19 and 24 mm. And even more specifically, the height 153 may be between about 21.3 mm and 21.4 mm, and yet even more specifically substantially equal to 21.35 mm, which equates to the radius of a typical golf ball. Extension of the center line 152 precisely at a height equivalent to a conventional golf ball radius renders moot the deficiencies in lateral alignment discussed above. However, these ranges recognize that some degree of deviation from this precise location may produce similar results so long as such deviation may not be visually perceptible during conventional use, and they are thus also acceptable. In certain alternative embodiments, the manufacturer may wish to take into account the fact that a putter will likely sink into turf more deeply due to gravity during the static preliminary position at address. Where it is recognized that a putter head by its design or intended environment of use may be susceptible to non-negligible sinking in turf under its own weight, an offset may thus be applied to the height 153 by increasing this height of the center line 152 by, say, 1 to 2 mm.

With alignment features such as the three-dimensional alignment feature 150, in which the center line 152 is coincident with the longitudinal axis of the alignment feature, there may be a difference between (i) the height 151 of the alignment feature from the lowermost point 123 and (ii)

the height 153 of the center line 152. In certain aspects, the height 151 may be no greater than 35 mm, more preferably between 21 mm and 28 mm, and even more preferably between 22 mm and 26 mm. This height difference may be representative of an alignment feature that, in cross-section, has a degree of symmetry about its center line (i.e., a cylindrical body). As such, the height 151 may be representative of the diameter or general size of the alignment feature about its center line. Accordingly, a height being within these ranges ensures that the alignment feature is sufficiently large to be easily viewed, but not so large as to compromise its ability to pinpoint a desired impact point on a golf ball. As a result, the height 151 may be greater than the height 153 by at least 1.5 mm. Alternatively, the height 151 may be greater than the height 153 by at least 2.5 mm.

As further shown in FIG. 6, the alignment feature 150 may have a length 154 of no less than 1 mm. The length of the alignment feature 150 may, however, be at any of a wide variety of lengths, e.g., up to 130 mm. Preferably, the length 154 is no greater than the width 170 of the club head, and even more preferably is no greater than the depth 160 of the club head. However, in some embodiments, the alignment feature 150 may extend further rearward than a rearward-most extend of a sole portion. Maintaining the length of the alignment feature 150 within this range ensures sufficient visibility of the alignment feature by enabling the user to envision an extrapolated trajectory path beyond the bounds of the alignment feature 150. However, limiting the alignment feature to this preferred range minimizes use of mass, thus increasing discretionary mass that may be positioned in a more suitable location, and it ensures compliance with golf equipment rules promulgated by one or more governing bodies such as the United States Golf Association ("USGA"). The alignment feature 150 may also form the center line 152 so as to be linear and/or parallel to the ground plane. In other words, the center line 152 may be in a horizontal plane that is perpendicular to the virtual vertical plane A-A'. However, it is also envisioned that the center line 152 may be formed so as to be angled upward or downward from this horizontal plane. In these angled situations, it is preferable that at least the portion of the center line 152 adjacent to the striking wall be at the height 153. Furthermore, because an angled, virtual, and infinite center line would necessarily encompass all heights, it may also be appropriate to measure the height 153 relative to a center line segment (e.g., the portion of the center line 152 corresponding with the alignment feature 150) in these angled situations.

Figure 7:
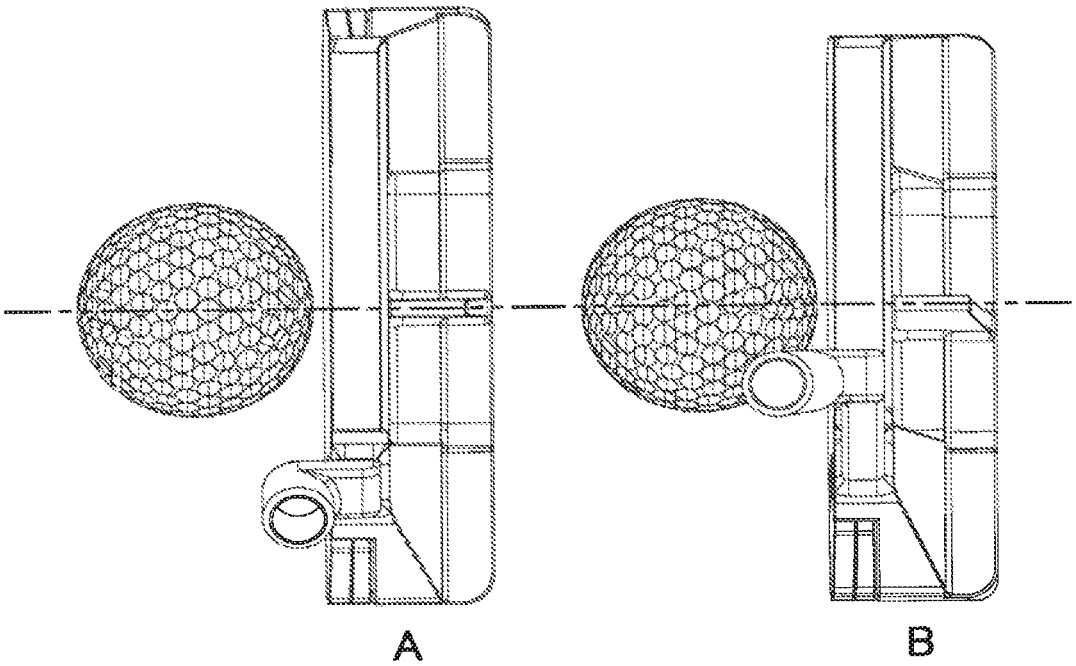
FIG. 7 shows the putter-type club head of FIG. 3 as viewed by a golfer at the static preliminary position at address.

In the above discussion, a non-limiting example has been described. As a result of this arrangement, the center line 152 substantially coincides with a central axis of a golf ball. Therefore, even when the golfer's eye position angularly wavers during the preliminary static fit at address, the perceived location of the center line 152 will remain constant relative to the golf ball and to the lateral center of the club head. This is schematically shown in FIG. 7, which reproduces positions A and B discussed above, but substitutes the prior art club head with the club head 100. In position A, in which the golfer's eyes are positioned directly over the club head, the center line 152, like that of the prior art club head, is perceived by the golfer to intersect both the lateral center of the club head and the center of the golf ball so as to enable alignment of the golf ball with the lateral center of the club head 100. But in position B, contrary to the prior art club head, the center line 152 is also perceived to remain laterally aligned with the centers of both the club head 100 and the golf ball, even when the golfer's eyes are angularly offset by 300. This feature enables more accurate lateral alignment of the club head 100.

Furthermore, the presence of the center line 152 as formed by the alignment feature 150 is quite obvious to a golfer and thereby provides attribution for the golfer's increased accuracy. This stands in contrast to, say, the higher-than-typical moment of inertia of the club head 100 resulting from removal of mass from the striking wall and toward the heel and toe of the rear portion 130. Although this higher-than-typical moment of inertia will generally lead to more forgiveness on off-centered shots (e.g., lower dispersion), this behavior is not immediately communicated to the golfer on appearance. Thus, alignment aid 150 may serve to communicate to a golfer a latent characteristic of the club head, thus aiding in the golfer's selection of a golf club best suited to his or her needs or playing ability.

Other non-limiting examples, such as two-dimensional alignment features, are envisioned as being within the scope of the invention. These two-dimensional alignment features may be formed, for example, by at least one of (i) a paint-filled reveal on a generally planar top surface; (ii) chem-etched indicia; (iii) laser-etched indicia; (iv) an inlay; (v) an insert with different visual characteristics than the surrounding club head; and (vi) a decal. In particular, the use of a decal in place of a paint fill is considered to be advantageous from a manufacturing cost perspective. Specific examples are discussed below. In these following examples, allusions to a virtual vertical plane A-A' refer to the virtual vertical plane A-A' shown in FIG. 5 (i.e., a virtual vertical plane that is perpendicular to the striking face and that passes through the face center). Additionally, allusions to a height 153 of the center line 152 refer to the height measurement 153 shown in FIG. 6. That is, the height 153 referred to hereinafter may be may be from 16 to 26 mm taken vertically from a lowermost point of the sole portion of the club head. More specifically, this height 153 may be between 19 and 24 mm. And even more specifically, this height 153 may be between about 21.3 mm and 21.4 mm, and yet even more specifically substantially equal to 21.35 mm, which equates to the radius of a typical golf ball.

Figure 8B:
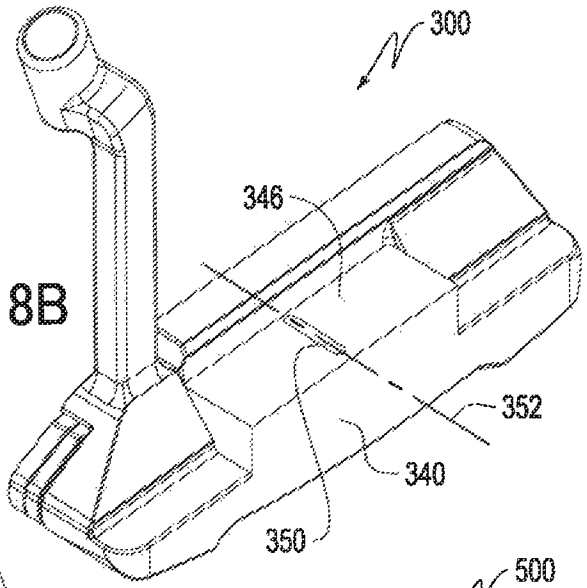
FIG. 8B shows a perspective view of an exemplary putter-type golf club head with an alignment feature in accordance with one or more aspects of the present invention.
Figure 8D:
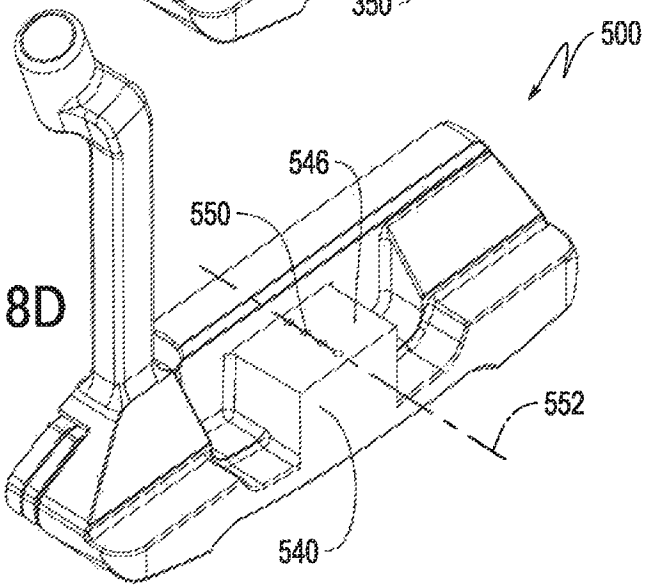
FIG. 8D shows a perspective view of an exemplary putter-type golf club head with an alignment feature in accordance with one or more aspects of the present invention.
Figure 8A:
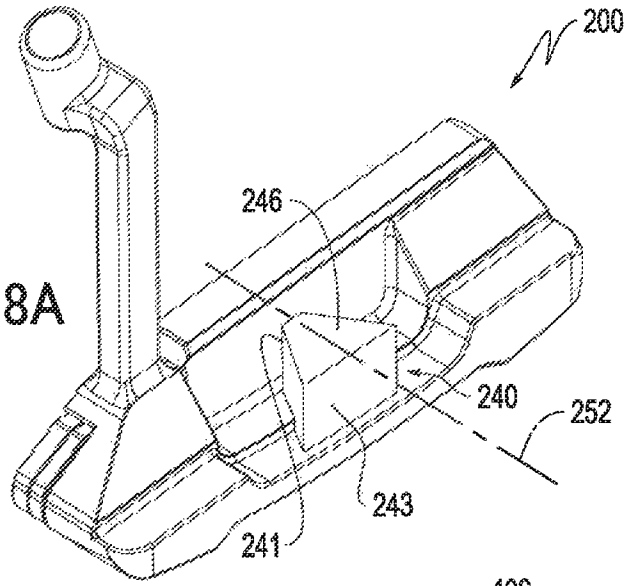
FIG. 8A shows a perspective view of an exemplary putter-type golf club head with an alignment feature in accordance with one or more aspects of the present invention.

In FIG. 8A, a putter-type golf club head 200 is shown. The club head 200 may comprise a triangular alignment projection 240 that projects from a rear portion top surface and that may be bisected by the virtual vertical plane A-A'. The width of the forward end 241 of the projection 240 (i.e., the end closest to the striking wall) in the heel-to-toe direction may be less than that of the rear end 243 of the projection 240, and the top surface 246 of the projection 240 may be parallel to the ground plane and may be at the same height above the lowermost point of the sole of the club head 200 as the height 153 of the center line 152. The projection 240 may thereby form a virtual center line 252 that is coincident with the virtual vertical plane A-A', that is parallel to the ground plane, and that intersects the center of the golf ball at the static preliminary position at address.

FIG. 8B shows a putter-type golf club head 300 that comprises a substantially rectangular alignment projection 340, a rear of which is coincident with a rear of the club head 300. Into the top surface 346 of the projection 340, an alignment feature 350 formed as a sightline is produced by at least one of the above-discussed methods. The sightline 350 may be in the virtual vertical plane A-A', it may be parallel to the ground plane, and it may be at the same height above the lowermost point of the sole of the club head 300 as the height 153 of the center line 152. The alignment feature 350 may thereby form a center line 352 that is coincident with the virtual vertical plane A-A', that is parallel to the ground plane, and that intersects the center of the golf ball at the static preliminary position at address.

Figure 8C:
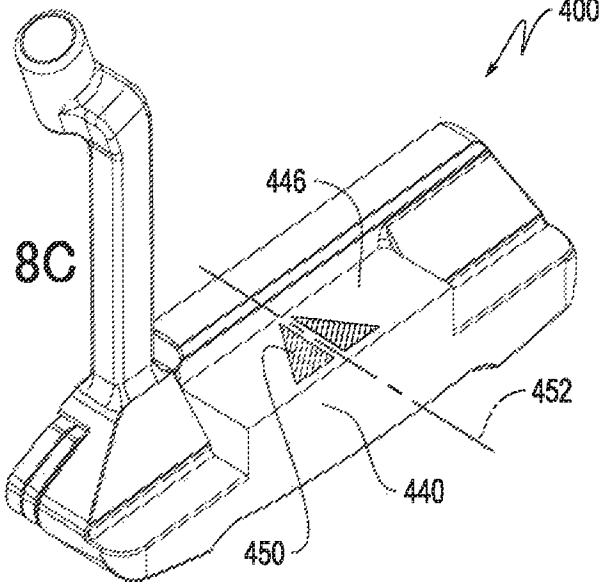
FIG. 8C shows a perspective view of an exemplary putter-type golf club head with an alignment feature in accordance with one or more aspects of the present invention.

FIG. 8C shows a putter-type golf club head 400 that comprises a substantially rectangular alignment projection 440, a rear of which is coincident with a rear of the club head 400. Into the top surface 446 of the projection 440, an alignment feature 450 may be formed as a pair of indicia by at least one of the above-discussed methods. The indicia of the alignment feature 450 may comprise a pair of right triangles that are equidistant in the heel-to-toe direction from the virtual vertical plane A-A', and they may be at the same height above the lowermost point of the sole of the club head 400 as the height 153 of the center line 152. The alignment feature 450 may thereby form a virtual center line 452 that is coincident with the virtual vertical plane A-A', that is parallel to the ground plane, and that intersects the center of the golf ball at the static preliminary position at address.

FIG. 8D shows a putter-type golf club head 500 that comprises a substantially rectangular alignment projection 540 that projects from a rear portion top surface of the club head 500 and a rear of which is coincident with a rear of the club head 500. On the top surface 546 of the projection 540, an alignment feature 550 may be formed as indicia by at least one of the above-discussed methods. The indicia of the alignment feature 550 may comprise a plurality of dots and/or dashes in the virtual vertical plane A-A' that project rearward from the striking wall, and they may be at the same height above the lowermost point of the sole of the club head 500 as the height 153 of the center line 152. The alignment feature 550 may thereby form a virtual center line 552 that is coincident with the virtual vertical plane A-A', that is parallel to the ground plane, and that intersects the center of the golf ball at the static preliminary position at address.

Although not shown, other two-dimensional alignment features are envisioned as being within the scope of the present invention. For example, two-dimensional alignment features that are arrow-shaped, heart-shaped, and chevron-shaped may be employed.

In addition to these two-dimensional alignment features, other three-dimensional alignment features may be employed so as to enable proper alignment. FIG. 9A, for example, shows a putter-type golf club head 600 that comprises an alignment feature 650 formed as a cylinder fixed to the top surface 634 of a recessed rear portion by way of a projection 640. The longitudinal axis of the alignment feature 650, which extends in the front-to-rear direction and which intersects a cross-sectional center of the alignment feature 650, may be in the virtual vertical plane A-A' and may be at the same height above the lowermost point of the sole of the club head 600 as the height 153 of the center line 152. The longitudinal axis of the alignment feature 650 may thereby form a virtual center line 652 that is coincident with the virtual vertical plane A-A', that is parallel to the ground plane, and that intersects the center of the golf ball at the static preliminary position at address.

Figure 9B:
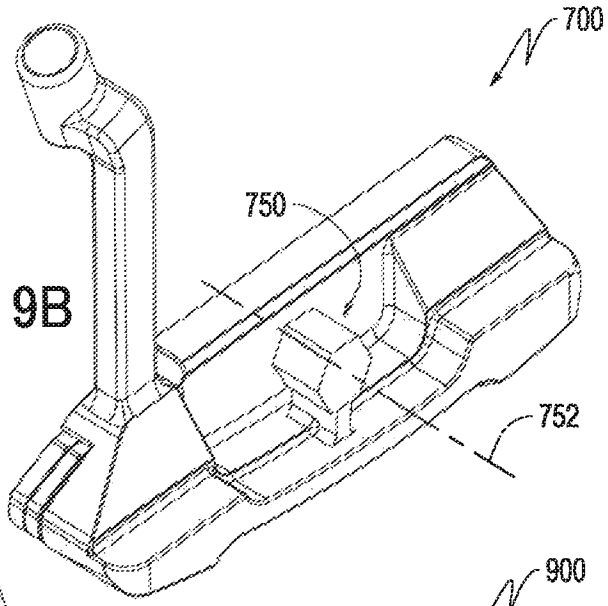
FIG. 9B shows a perspective view of an exemplary putter-type golf club head with an alignment feature in accordance with one or more aspects of the present invention.

FIG. 9B shows a putter-type golf club head 700 that comprises an alignment feature 750 having the cross-sectional shape of a polygon. For example, the alignment feature 750 may have the cross-sectional shape of a hexagon or of an octagon, or it may have the cross-sectional shape of a pentagon as shown in FIG. 9B. As with the cylindrical alignment feature 650, the longitudinal axis of the alignment feature 750, which extends in the front-to-rear direction and which intersects the cross-sectional center of the alignment feature 750, may be in the virtual vertical plane A-A' and may be at the same height above the lowermost point of the sole of the club head 700 as the height 153 of the center line 152. The longitudinal axis of the alignment feature 750 may thereby form a virtual center line 752 that is coincident with the virtual vertical plane A-A' and that intersects the center of the golf ball at the static preliminary position at address.

Figure 9D:
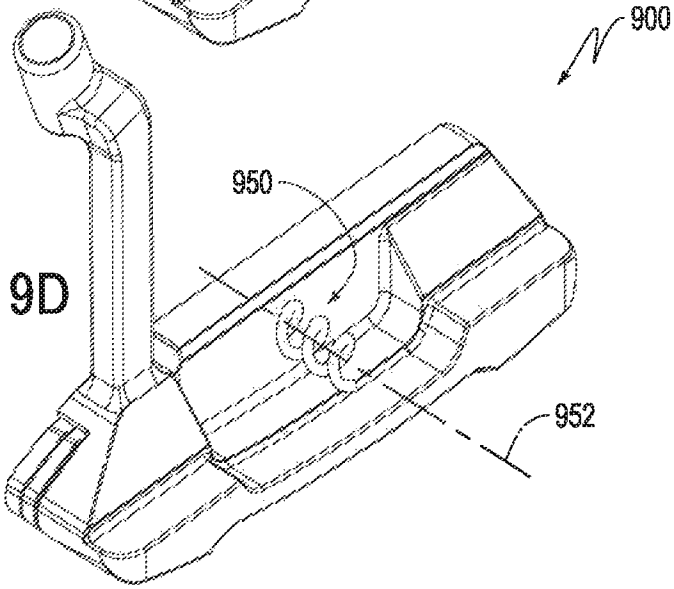
FIG. 9D shows a perspective view of an exemplary putter-type golf club head with an alignment feature in accordance with one or more aspects of the present invention.
Figure 9A:
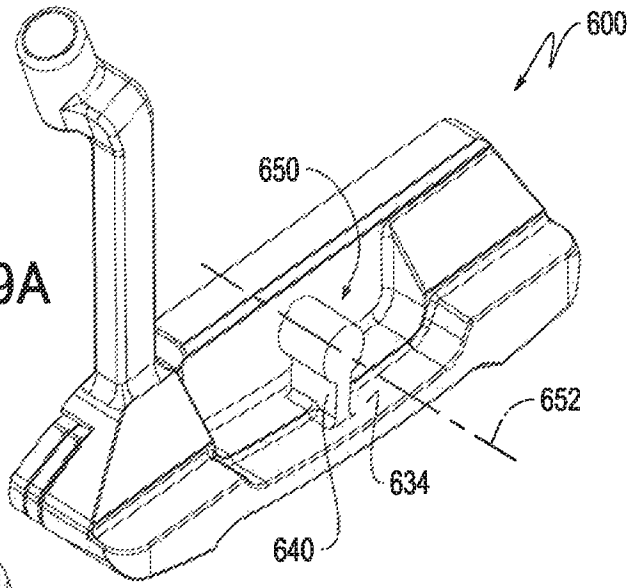
FIG. 9A shows a perspective view of an exemplary putter-type golf club head with an alignment feature in accordance with one or more aspects of the present invention.
Figure 9C:
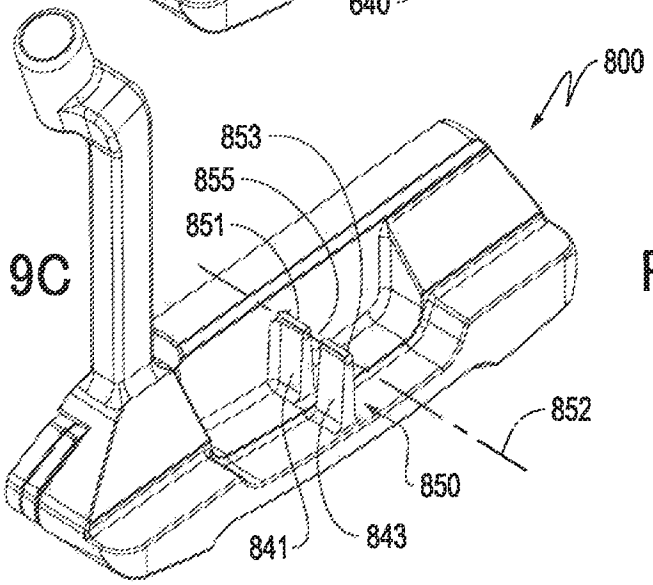
FIG. 9C shows a perspective view of an exemplary putter-type golf club head with an alignment feature in accordance with one or more aspects of the present invention.

FIG. 9C shows a putter-type golf club head 800 that comprises an alignment feature 850 including a plurality of partial cylindrical bodies. Two partial cylindrical bodies 851, 853 are shown in FIG. 9C, but there may be more. The partial cylindrical bodies 851, 853 may be respectively elevated from the top surface of a recessed rear portion of the club head 800 by projections 841, 843, and they may be separated from each other by a gap 855. The longitudinal axis of each of the partial cylindrical bodies 851, 853, which extends in the front-to-rear direction and which intersects the cross-sectional center of the cylinder, may be in the virtual vertical plane A-A' and may be at the same height above the lowermost point of the sole of the club head 800 as the height 153 of the center line 152. The longitudinal axes of the partial cylindrical bodies 851, 853 may thereby form a virtual center line 852 that is coincident with the virtual vertical plane A-A', that is parallel to the ground plane, and that intersects the center of the golf ball at the static preliminary position at address.

FIG. 9D shows a putter-type golf club head 900 that comprises a helical alignment feature 950. This alignment feature 950 may be formed by, say, a metal wire coiled about a longitudinal axis extending in the front-to-rear direction. The longitudinal axis may be in the virtual vertical plane A-A', and it may be at the same height above the lowermost point of the sole of the club head 900 as the height 153 of the center line 152. The longitudinal axis of the alignment feature 950 may thereby form an imaginary center line 952 that is coincident with the virtual vertical plane A-A', that is parallel to the ground plane, and that intersects the center of the golf ball at the static preliminary position at address.

Figure 9F:
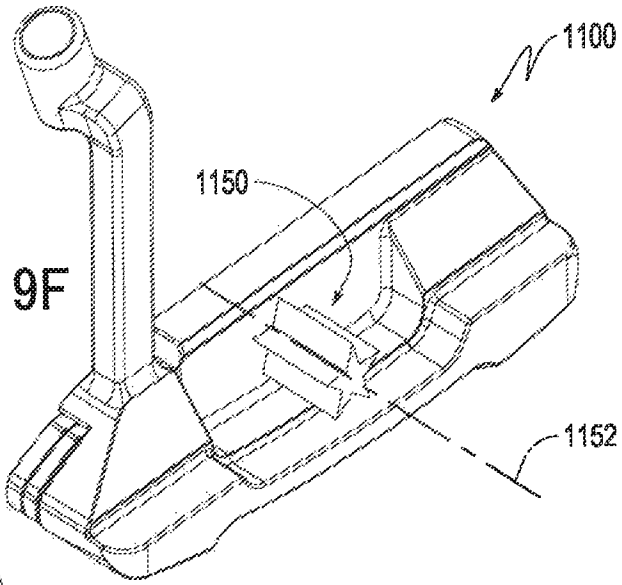
FIG. 9F shows a perspective view of an exemplary putter-type golf club head with an alignment feature in accordance with one or more aspects of the present invention.
Figure 9H:
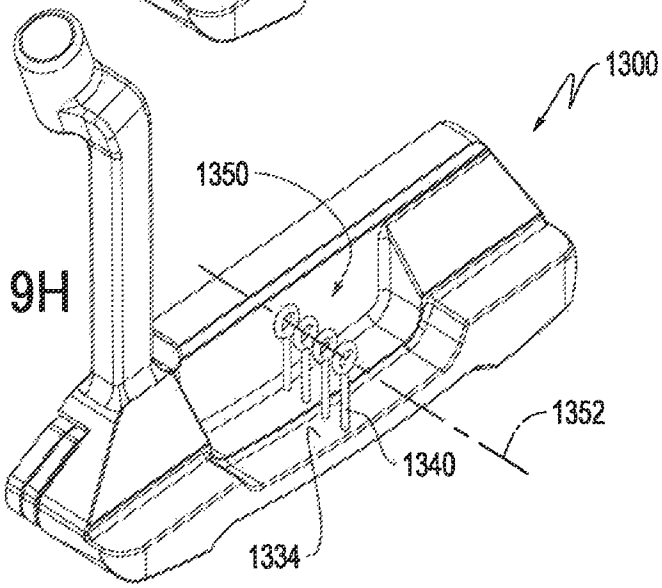
FIG. 9H shows a perspective view of an exemplary putter-type golf club head with an alignment feature in accordance with one or more aspects of the present invention.
Figure 9E:
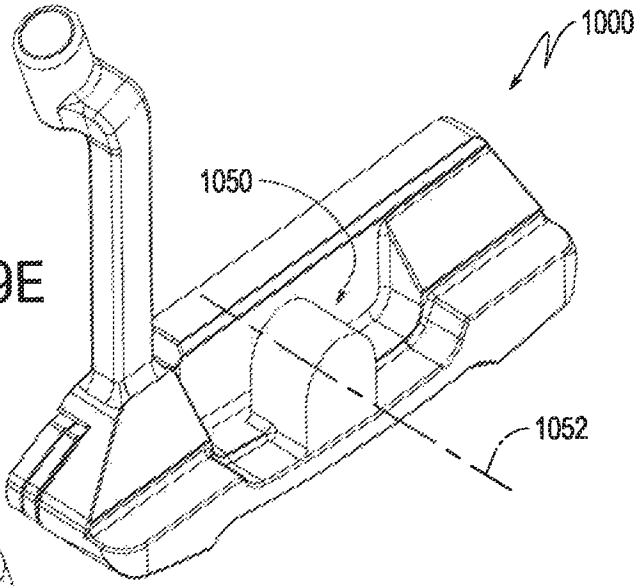
FIG. 9E shows a perspective view of an exemplary putter-type golf club head with an alignment feature in accordance with one or more aspects of the present invention.

FIG. 9E shows a putter-type golf club head 1000 that comprises a half-cylinder alignment feature 1050 projecting from the top surface of a recessed rear portion of the golf club head 1000. The center of mass of the alignment feature 1050 may be in the virtual vertical plane A-A', and it may be at the same height above the lowermost point of the sole of the club head 1000 as the height 153 of the center line 152. The center of mass of the alignment feature 1050 may thereby be intersected by a virtual center line 1052 that is coincident with the virtual vertical plane A-A', that is parallel to the ground plane, and that intersects the center of the golf ball at the static preliminary position at address.

Figure 9G:
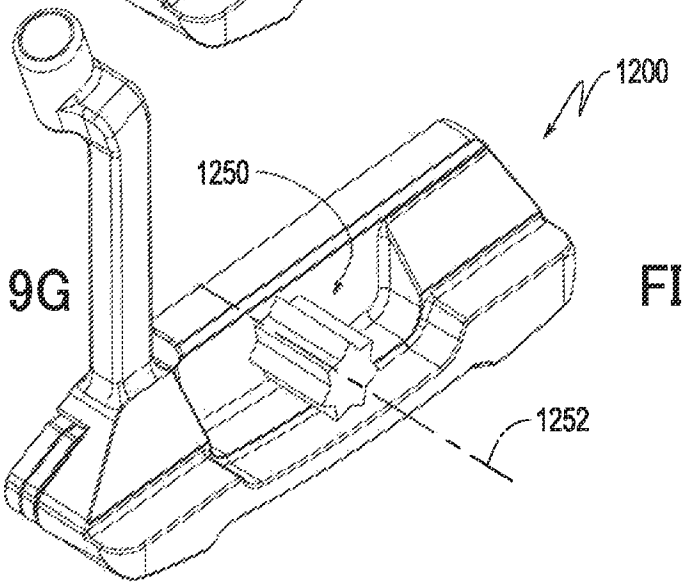
FIG. 9G shows a perspective view of an exemplary putter-type golf club head with an alignment feature in accordance with one or more aspects of the present invention.

FIGS. 9F and 9G show, respectively, putter-type golf club heads 1100 and 1200 that comprise alignment features 1150, 1250 that are star-shaped in cross-section. The alignment feature 1150 may be a five-point star, and the alignment feature 1250 may be a six-point star. Longitudinal axes of the alignment aids 1150, 1250, which extend in the front-to-rear direction and which pass through the cross-sectional centers of their respective alignment features, may be in the virtual vertical plane A-A', and they may be at the same height above the lowermost point of the soles of the club heads 1100, 1200 as the height 153 of the center line 152. The longitudinal axes of the alignment features 1150, 1250 may thereby form virtual center lines 1152, 1252 that are coincident with the virtual vertical plane A-A', that are parallel to the ground plane, and that intersect the center of the golf ball at the static preliminary position at address.

FIG. 9H shows a putter-type golf club head 1300 that comprises an alignment feature 1350 formed as a plurality of rings fixed to the top surface 1334 of a recessed rear portion of the club head 1300 by way of projections 1340. Cross-sectional centers of the rings may be in the virtual vertical plane A-A', and they may be at the same height above the lowermost point of the sole of the club head 1300 as the height 153 of the center line 152. The cross-sectional centers of the rings may thereby form a virtual center line 1352 that is coincident with the virtual vertical plane A-A', that is parallel to the ground plane, and that intersects the center of the golf ball at the static preliminary position at address.

Figure 9J:
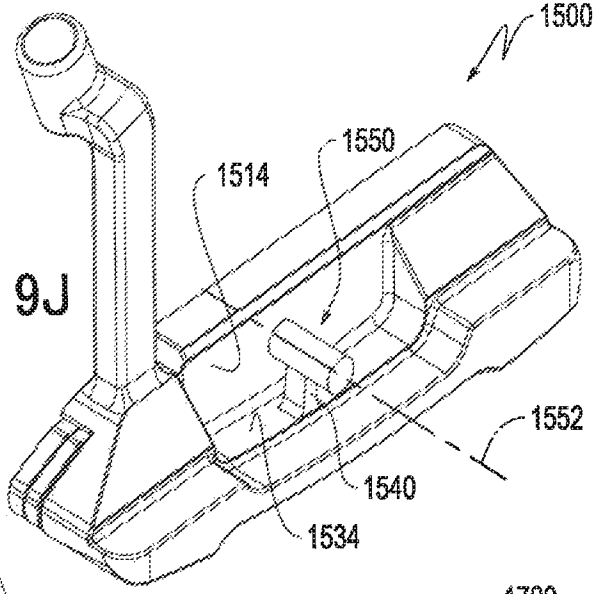
FIG. 9J shows a perspective view of an exemplary putter-type golf club head with an alignment feature in accordance with one or more aspects of the present invention.
Figure 9L:
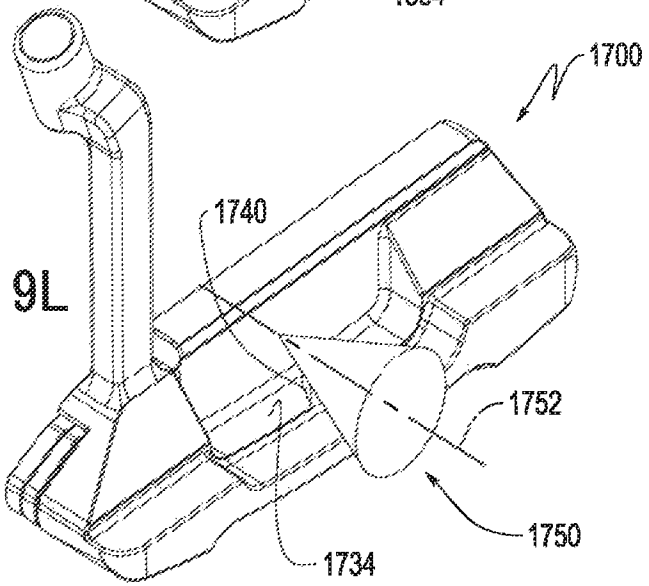
FIG. 9L shows a perspective view of an exemplary putter-type golf club head with an alignment feature in accordance with one or more aspects of the present invention.
Figure 9I:
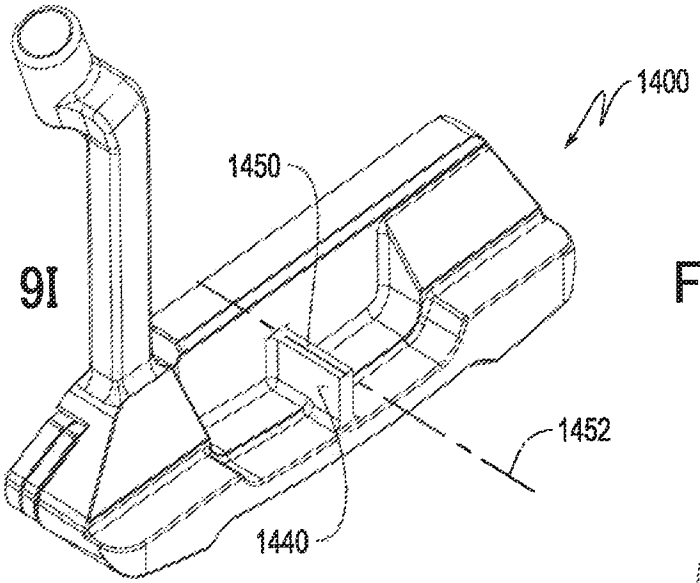
FIG. 9I shows a perspective view of an exemplary putter-type golf club head with an alignment feature in accordance with one or more aspects of the present invention.

FIG. 9I shows a putter-type golf club head 1400 that comprises an alignment feature 1450 formed as a planar top edge of a projection 1440. This planer top edge extends in the front-to-rear direction, and a center of the edge in the heel-to-toe direction may be in the virtual vertical plane A-A', and it may be at the same height above the lowermost point of the sole of the club head 1400 as the height 153 of the center line 152. The alignment feature 1450 constituted by the planar top edge of the projection 1440 may thereby form an imaginary center line 1452 that is coincident with the virtual vertical plane A-A', that is parallel to the ground plane, and that intersects the center of the golf ball at the static preliminary position at address.

FIG. 9J shows, similar to FIG. 9A, a putter-type golf club head 1500 that comprises an alignment feature 1550 formed as a cylinder fixed to the top surface 1534 of a recessed rear portion of the club head 1500 by way of a projection 1540. As with the alignment feature 650 in FIG. 9A, the longitudinal axis of the alignment feature 1550, which extends in the heel-to-toe direction and which intersects a cross-sectional center of the cylinder, may be in the virtual vertical plane A-A', and it may be at the same height above the lowermost point of the sole of the club head 1500 as the height 153 of the center line 152. The longitudinal axis of the alignment feature 1550 may thereby form a virtual center line 1552 that is coincident with the virtual vertical plane A-A', that is parallel to the ground plane, and that intersects the center of the golf ball at the static preliminary position at address. However, unlike the alignment feature 650, the forward end of the alignment feature 1550 may be spaced from the opposing rear surface 1514 of the striking wall of the club head 1500.

Figure 9K:
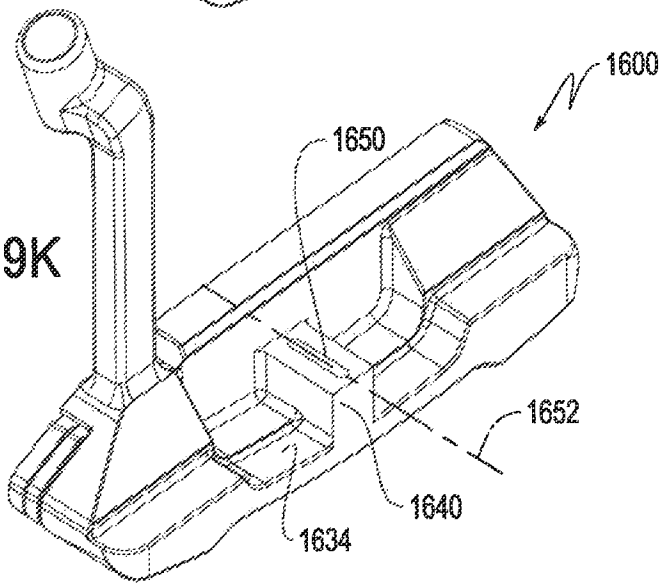
FIG. 9K shows a perspective view of an exemplary putter-type golf club head with an alignment feature in accordance with one or more aspects of the present invention.

FIG. 9K shows a putter-type golf club head 1600 that comprises an alignment feature 1650 formed as an indicia on a top surface of a narrow projection 1640 that extends from the top surface 1634 of a recessed rear portion of the club head 1600. The indicia may extend in the heel-to-toe direction so as to be in the virtual vertical plane A-A', and it may be at the same height above the lowermost point of the sole of the club head 1600 as the height 153 of the center line 152. The indicia constituting the alignment feature 1650 may thereby form an imaginary center line 1652 that is coincident with the virtual vertical plane A-A', that is parallel to the ground plane, and that intersects the center of the golf ball at the static preliminary position at address.

FIG. 9L shows a putter-type golf club head 1700 that comprises a frustro-conical alignment feature 1750 fixed to the top surface 1734 of a recessed rear portion of the club head 1700 by way of a projection 1740. As shown in FIG. 9L, the cross-sectional area of the frustro-conical alignment feature 1750 may increase toward the rear of the club head 1700. Alternatively, however, the alignment feature 1750 may be oppositely oriented so that its cross-sectional area increases toward the front of the club head 1700. The longitudinal axis of the alignment feature 1750, which extends in the heel-to-toe direction and which intersects the cross-sectional center of the feature, may be in the virtual vertical plane A-A', and it may be at the same height above the lowermost point of the sole of the club head 1700 as the height 153 of the center line 152. The longitudinal axis of the alignment feature 1750 may thereby form a virtual center line 1752 that is coincident with the virtual vertical plane A-A', that is parallel to the ground plane, and that intersects the center of the golf ball at the static preliminary position at address.

Figure 9M:
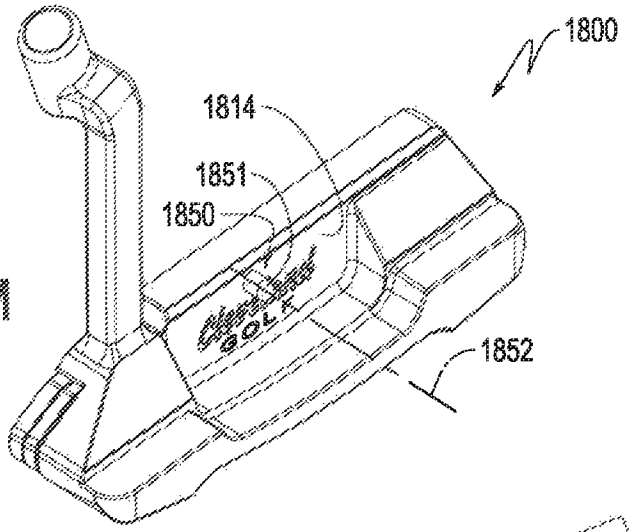
FIG. 9M shows a perspective view of an exemplary putter-type golf club head with an alignment feature in accordance with one or more aspects of the present invention.

Finally, FIG. 9M shows a putter-type golf club head 1800 that comprises an alignment feature 1850. The alignment feature 1850 may be generally cylindrical in shape, and it may project from the opposing rear surface 1814 of the striking wall of the club head 1800. As shown in FIG. 9M, the rear end of the alignment feature 1851 may be domed, or rounded, but this need not be the case. The longitudinal axis of the alignment feature 1850, which extends in the heel-to-toe direction and which intersects a cross-sectional center of the alignment feature 1850, may be in the virtual vertical plane A-A', and it may be at the same height above the lowermost point of the sole of the club head 1800 as the height 153 of the center line 152. The longitudinal axis of the alignment feature 1850 may thereby form a virtual center line 1852 that is coincident with the virtual vertical plane A-A', that is parallel to the ground plane, and that intersects the center of the golf ball at the static preliminary position at address.

Figure 10B:
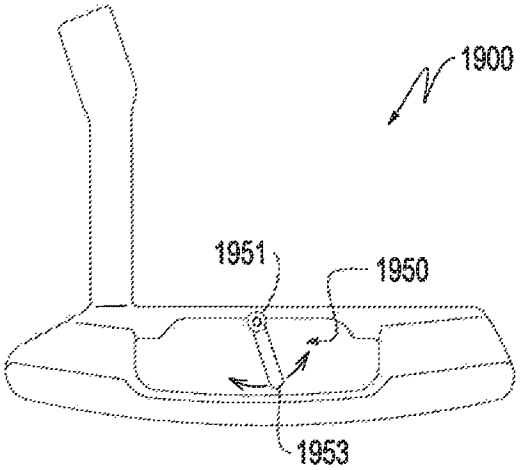
FIG. 10B shows a rear side view of the putter-type golf club head of FIG. 10A.
Figure 10A:
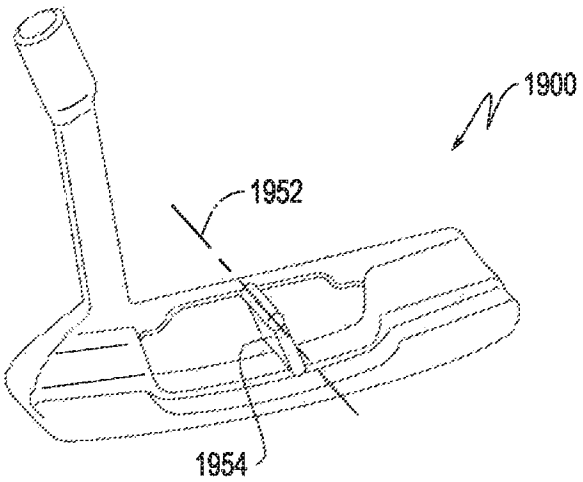
FIG. 10A shows a perspective view of an exemplary putter-type golf club head with a pivotable alignment feature in accordance with one or more aspects of the present invention.

In all of the previously-discussed examples, the alignment features have been fixed in position relative to the remainder of the club head. But this need not be the case. For example, FIGS. 10A and 10B show a putter-type golf club head 1900 that may comprise an alignment feature 1950. This alignment feature 1950 may include a securing member 1951 by which the alignment feature 1950 is secured to the striking wall of the club head 1900, and it may also include a pivoting portion 1953 projecting from the securing member 1951 downward toward the sole of the club head 1900. The pivoting portion 1953 may rotate about the axis of the securing member 1951 as shown in FIGS. 10A and 10B so as to be situated in any number of possible angular positions relative to the striking wall, and sides 1954 of the pivoting portion 1953 may be colored and/or textured. The longitudinal axis of the securing member 1951 may project in the front-to-rear direction so as to be in the virtual vertical plane A-A', and it may be at the same height above the lowermost point of the sole of the club head 1900 as the height 153 of the center line 152. The longitudinal axis of the securing member 1951 may thereby form an imaginary center line 1952 that is coincident with the virtual vertical plane A-A', that is parallel to the ground plane, and that intersects the center of the golf ball at the static preliminary position at address.

Figure 1:
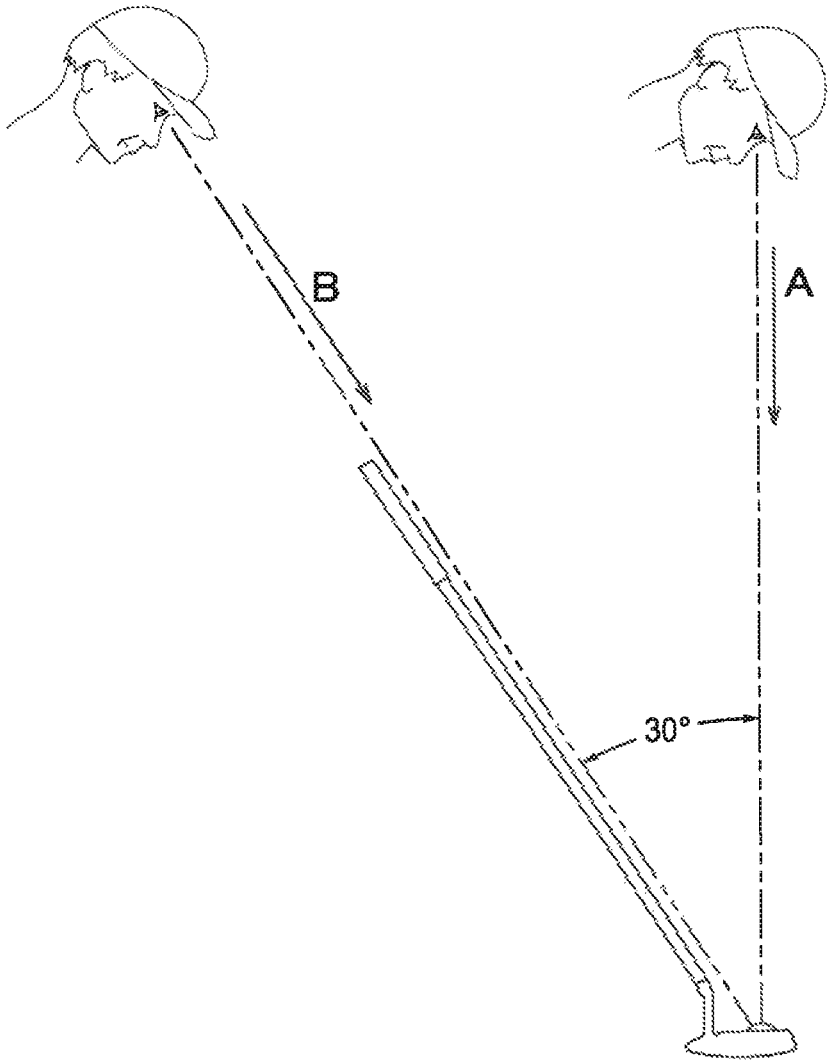
FIG. 1 shows the angular offset of a golfer's eyes at the static preliminary position at address.
Figure 2:
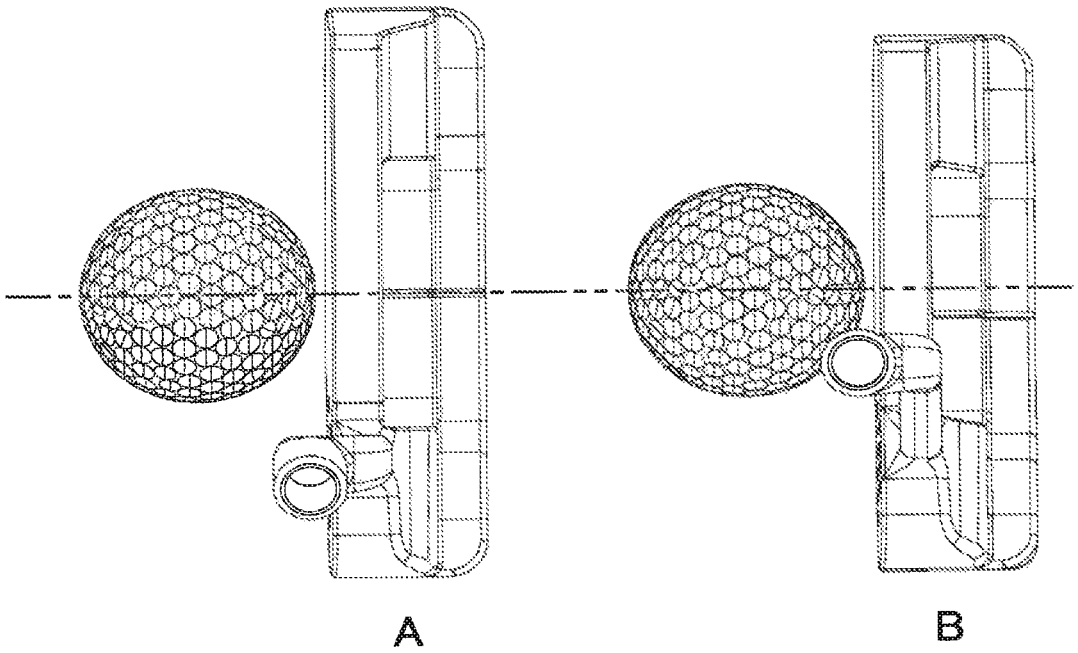
FIG. 2 PRIOR ART
FIG. 2 shows a prior art putter-type club head with a sightline as viewed by a golfer at the static preliminary position at address.

Pivotable alignment features such as the alignment feature 1950 may further aid a golfer in achieving proper alignment at the static preliminary position at address. As shown in FIG. 1, a golfer's eyes may not be positioned directly over the club head. Rather, they may be angularly offset. To accommodate this offset, the angular position of the pivoting portion 1953 relative to the striking wall may be pre-set at a preliminary club fitting so as to correspond to a golfer's preferred putting stance by, say, ensuring that the sides 1954 of the pivoting portion 1953 are parallel to the virtual line connecting the golfer's eyes to the center line 1952. If the golfer later maintains this preferred stance at the static preliminary position and if the club head is properly angled in the heel-to-toe direction, he should not see the sides 1954, or alternatively should minimally see the sides. But if the golfer deviates from the preferred stance, or if the club head is improperly angled in the heel-to-toe direction, he should see the texture and/or coloring of the sides 1954, thereby indicating to the golfer that either he or the club head is not properly aligned.

Figure 11A:
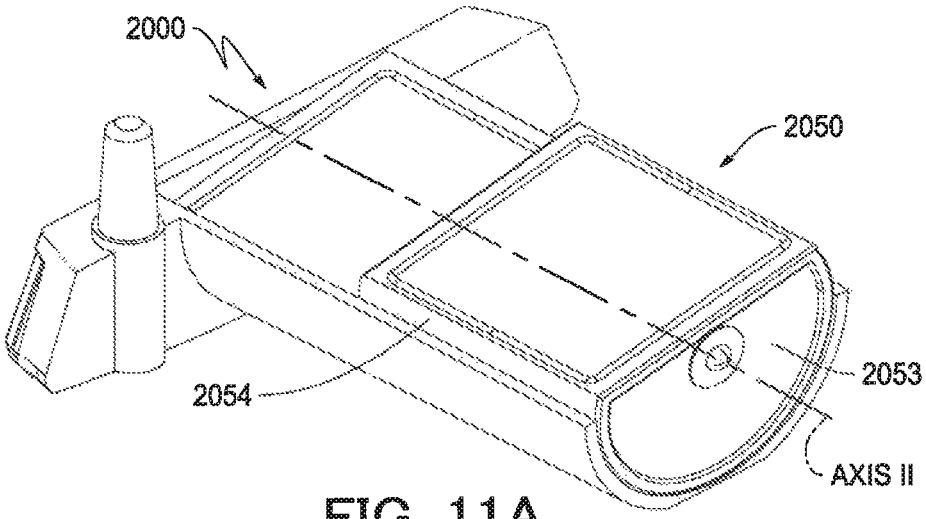
FIG. 11A shows a perspective view of an exemplary putter-type golf club head with a pivotable alignment feature in accordance with one or more aspects of the present invention.
Figure 11B:
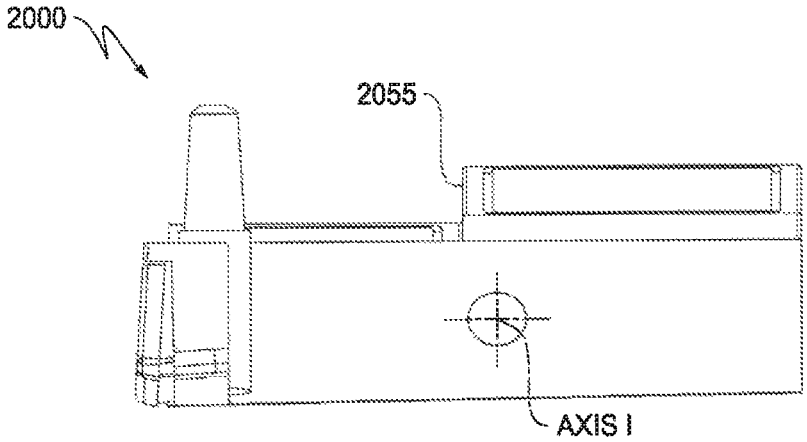
FIG. 11B shows a side view of the putter-type golf club head according to FIG. 11A.
Figure 11C:
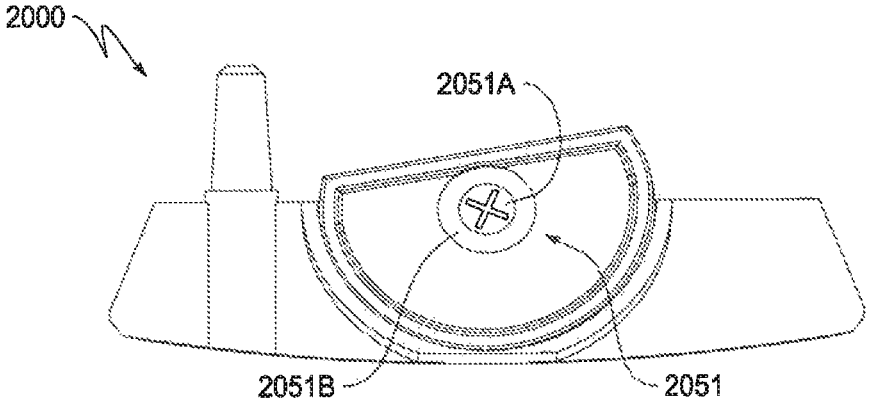
FIG. 11C shows a rear side view of the putter-type golf club head according to FIG. 11A.

A pivotable alignment feature may also be incorporated into other putter-type club heads. For example, FIGS. 11A-11C show a SmartSquare-type club head 2000, structures and advantages of which are disclosed in U.S. patent application Ser. Nos. 14/166,289 and 14/311,047, the disclosures of which are herein incorporated by reference. This club head 2000 may include an alignment feature 2050 comprising a portion 2053 that pivots about an Axis II, which is preferably coincident with the virtual vertical plane A-A', preferably is parallel to the ground plane, and preferably intersects the center of the golf ball at the static preliminary position at address. The Axis II is also preferably at the same height above the lowermost point of the sole of the club head 2000 as the height 153 of the center line 152. A securing member 2051, which may be coincident with the Axis II, may secure the pivoting portion 2053 to the remainder of the club head 2000. As with the pivoting portion 1953 in FIGS. 10A and 10B, the angular position of the pivoting portion 2053 about the Axis II may be pre-set at a preliminary club fitting so as to correspond to a golfer's preferred putting stance.

As further shown in FIGS. 11A-11C, the portion 2053 may include side surfaces 2054 and 2055. Side surfaces 2054 face toward the toe or heel of the club head 2000, and side surfaces 2055 face toward the front or rear of the club head. Side surfaces 2054 will be visible to the golfer when the club head 2000 is misaligned about the Axis II (e.g., angled from the ground plane in the heel-to-toe direction), and the side surfaces 2055 will be visible to the golfer when the club head 2000 is misaligned about an Axis I (e.g., angled relative to the ground plane in the front-to-rear direction). Therefore, like the alignment feature 1950, the alignment feature 2050, may aid the golfer in achieving proper alignment at the static preliminary position at address.

As even further shown in FIGS. 11A-1C, the pivoting portion 2053 may be fixed in place relative to the remainder of the club head 2000 by virtue of a friction fit created by the securing member 2051. In this arrangement, the securing member 2051 may be constituted by a screw 2051A and a washer 2051B, which work together to apply pressure to the pivoting portion 2053. But other mechanisms may be used to secure the pivoting portion. For example, the pivoting portion could instead have anti-rotation surfaces (e.g., splines, notches, or a non-circular cross-section) that mate with complementary surfaces on the main body of the club head. Alternatively, the pivoting portion could be fixed relative to the remainder of the club head by both a friction fit and anti-rotation surfaces.

Figure 12:
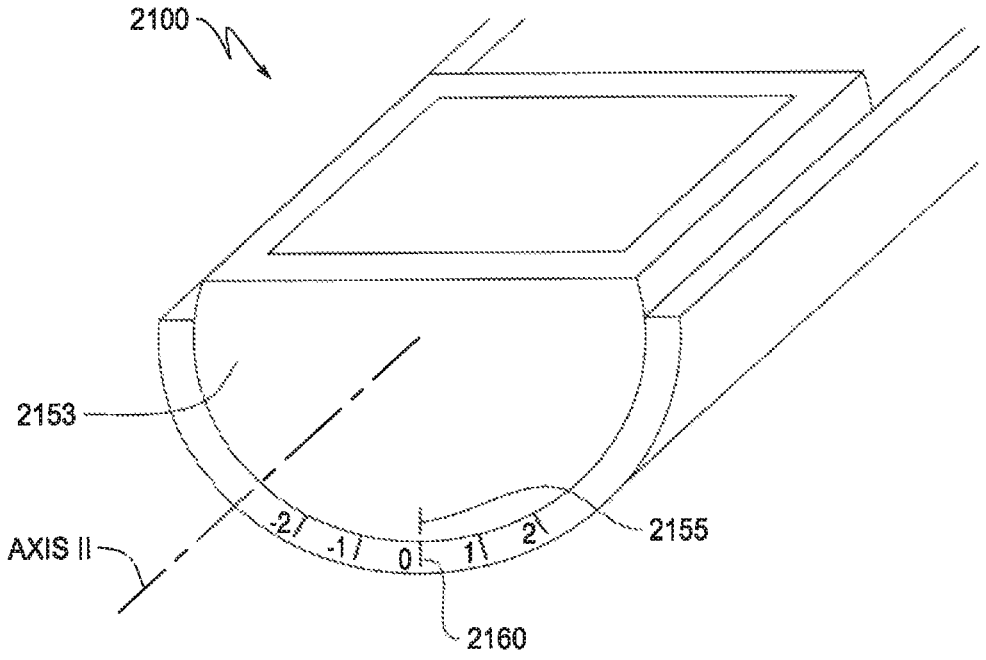
FIG. 12 shows a rear view of an exemplary putter-type golf club head with a pivotable alignment feature in accordance with one or more aspects of the present invention.

Furthermore, various indicia could be provided to indicate the angular offset of the pivoting portion. FIG. 12 shows a club head 2100 that is substantially similar to the club head 2000, but it also includes indicia 2160 on the main body of the club head 2000 and indicia 2155 on the pivoting portion 2153 of the alignment feature. As the pivoting portion 2153 pivots about the Axis II, the indicia 2155 may angularly move with the pivoting portion 2153, but the indicia 2160 remains in a relatively fixed position. As a result, the indicia 2155, 2160 may work in concert to indicate to a golfer the angular displacement of the pivoting portion 2153 about the Axis II.

In the foregoing discussion, the present invention has been described with reference to specific exemplary aspects thereof. However, it will be evident that various modifications and changes may be made to these exemplary aspects without departing from the broader spirit and scope of the invention. For example, although the present invention has been primarily described with reference to a blade-type putter club head, it may be employed on any putter-type club head, such as mallet or T-shaped putters. The present invention may also be incorporated into a training aid, or it may be an attachable component to an existing club head. Accordingly, the foregoing discussion and the accompanying drawings are to be regarded as merely illustrative of the present invention rather than as limiting its scope in any manner.

What is claimed is:

1. A putter-type golf club head that, when oriented in a reference position, comprises:
- a face portion having a striking face with a face center;
- a sole portion extending rearwardly from the face portion;
- a heel portion;
- a toe portion opposite the heel portion; and
- an alignment element extending rearwardly from the face portion, the alignment element comprising:
  - opposite sidewalls that extend parallel to each other;
  - a rear wall substantially perpendicular to the opposite sidewalls and having a length in a heel-to-toe direction greater than a height of the rear wall; and
  - a top surface comprising a sightline that defines a center line segment not spaced more than 10 mm from a virtual vertical plane passing through the face center and extending generally perpendicular to the striking face, the center line segment having a substantially constant height between 21.3 mm and 21.4 mm from a bottommost point of the sole.

2. The golf club head of claim 1, wherein the center line segment is not spaced more than 5 mm from the virtual vertical plane.

3. The golf club head of claim 1, wherein the center line segment is substantially coincident with the virtual vertical plane.

4. The golf club head of claim 1, wherein a width of the golf club head is no less than 3.0 inches.

5. The golf club head of claim 1, wherein a length of the alignment element is no greater than a width of the golf club head.

6. The golf club head of claim 1, wherein the center line segment is located above the face center.

7. The golf club head of claim 1, wherein a height of the golf club head is greater than 21.35 mm.

8. A putter-type golf club head that, when oriented in a reference position, comprises:
- a face portion having a striking face with a face center;
- a sole portion extending rearwardly from the face portion;
- a heel portion;
- a toe portion opposite the heel portion; and
- an alignment projection having
  - a substantially rectangular top surface,
  - opposing parallel sidewalls, and
  - a rear wall substantially perpendicular to the opposing sidewalls and having a length in a heel-to-toe direction greater than a height of the rear wall;
- wherein the alignment projection:
  - is disposed between the heel portion and the toe portion;
  - is in communication with the face portion; and
  - extends rearwardly from the face portion, the alignment projection's top surface comprising a sightline that defines a center line segment spaced not more than 10 mm from a virtual vertical plane passing through the face center and extending generally perpendicular to the striking face, the sightline having a substantially constant height between 21.3 mm and 21.4 mm from a bottommost point of the sole.

9. The golf club head of claim 8, wherein the center line segment is spaced not more than 5 mm from the virtual vertical plane.

10. The golf club head of claim 8, wherein the center line segment is substantially coincident with the virtual vertical plane.

11. The golf club head of claim 8, wherein a width of the golf club head is no less than 3.0 inches.

12. The golf club head of claim 8, wherein a length of the alignment projection is no greater than a width of the golf club head.

13. The golf club head of claim 8, wherein the center line segment is located above the face center.

14. The golf club head of claim 8, wherein a height of the golf club head is greater than 21.35 mm.

* * * * *